US005308254A

United States Patent [19]

Hatagishi et al.

[11] Patent Number: 5,308,254

[45] Date of Patent: May 3, 1994

[54] CONNECTORS CONNECTING DEVICE

[75] Inventors: Yuji Hatagishi; Naoto Taguchi, both of Shizuoka, Japan

[73] Assignee: Yazaki Corporation, Tokyo, Japan

[21] Appl. No.: 26,636

[22] Filed: Mar. 5, 1993

[30] Foreign Application Priority Data

Mar. 17, 1992 [JP] Japan ..... 4-060321

[51] Int. Cl.[5] ..... H01R 13/00

[52] U.S. Cl. ..... 439/157

[58] Field of Search ..... 439/152-160

[56] References Cited

U.S. PATENT DOCUMENTS 5,035,634 7/1991 Hasircoglu et al. ..... 439/157

5,174,785 12/1992 Endo et al. ..... 439/157

FOREIGN PATENT DOCUMENTS 2-278674 11/1990 Japan .

*Primary Examiner*—Joseph H. McGlynn

*Attorney, Agent, or Firm*—Sughrue, Mion, Zinn, Macpeak & Seas

[57] ABSTRACT

A connector device for connecting and disconnecting female and male connectors by use of a fitting operation lever which allows easy and accurate confirmation of the incomplete fitting of the connectors to thereby prevent such incomplete fitting. The device includes a fitting operation lever (5), which is rotatably disposed in a female connector (A) and has a driving groove (6) in the front end portion thereof, and a driven pin (11) which is provided in a male connector (B) and is engageable with the drive groove (6). The connecting device connects the female and male connectors (A) and (B) with each other and disconnects them from each other upon rotation of the fitting operation lever (5). When the connectors are only partially connected to each other, there is some space for free and easy movement in the operation lever which allows the lever (5) to rotate in the reverse, un-locking direction due to its own weight. Thus, the incomplete connection can be visually detected.

9 Claims, 5 Drawing Sheets

CONNECTORS CONNECTING DEVICE

BACKGROUND OF THE INVENTION

1. Field of the Invention

The present invention relates to a connecting device for interconnecting a pair of connectors mainly used to connect an automobile wire harness.

2. Background

Referring to FIGS. 7–9, a conventional connector device includes a male connector a and a female connector b each having terminal metal fittings therein which are connected to each other when the two connectors a and b are connected together, as disclosed in Japanese Utility Model Publication No. 52-133993.

The male connector a includes a fitting operation lever c which is pivotally mounted to the male connector a so as to pivot about shaft d. The fitting operation lever c has a driving groove e in the front end portion thereof and an operation portion f in the rear end portion thereof. The operation portion f includes an engaging projection g at the distal end of the lever. After the lever is rotated clockwise to facilitate the interconnection of the connectors, the engaging projection g of the lever is engaged with an engagement portion g' provided in the male connector a to retain the connectors in the interconnected state. On the other hand, the female connector b includes on the outer surface thereof a driven pin h which opposes the driving groove e of the lever c.

In such a conventional connector device, the male and female connectors a and b are provisionally located with respect to each other in a position where the respective terminal metal fittings i and i' are aligned with each other. From this position, the fitting operation lever c is rotated, causing the fitting side wall $e_1$ of the driving groove e to engage the driven pin h such that further rotation of the lever c causes the groove wall $e_1$ to urge against the pin h. Therefore, as shown in FIGS. 8 and 9, the male and female connectors a and b are completely fitted with each other. In this state, the engaging projection g rotates beyond the engagement portion g', resulting in the male and female connectors being engaged and locked together.

However, as shown in FIG. 8, occasionally the fitting operation lever c is not rotated sufficiently far to engage the engaging projection g with engagement portion g'. Since it is difficult to visually confirm that the lever is locked, the connectors are often secured to each other in an un-locked state. During operation, the vibration generated by the automobile causes the connectors to become slightly disconnected from each other resulting in poor electrical contact between the connectors.

The reason that the lever is prematurely stopped before it reaches the locked position is because the contact resistance of the terminal metal fittings i and i' reaches a maximum when the connectors approach the completely locked state. In addition, there is an added resistance associated with moving the engaging projection g over the engagement portion g'. As a result, a relatively large force is required causing an operator to mistakenly believe that complete fitting is achieved. Further, if the operation is stopped in a state shown in FIG. 8, then gravity acts on the fitting operation lever c tending to rotate it in the opposite, un-locking direction. Accordingly, contact resistance between the terminal metal fittings i and i' prevents the male and female connectors a and b from further moving. Moreover, the driven pin h is in close contact with both the fitting side wall $e_1$ and disconnecting side wall $e_2$ of the driving groove e, so that the fitting operation lever c is left in the above mentioned state (i.e., in the position illustrated in FIG. 8).

An object of the present invention is to eliminate the drawbacks found in the above-mentioned conventional connecting device. Accordingly, it is an object of the invention to provide a connector device which, when the rotational operation of a fitting operation lever is prematurely interrupted so that the operating lever is disposed in an interrupted position before the connectors are completely fitted and locked, allows the interrupted position of the lever to be readily viewed from the outside and thereby prevents the incomplete fitting of the connectors.

SUMMARY OF THE INVENTION

In order to achieve the above object, according to the invention, there is provided a connecting device including a fitting operation lever rotatably provided in one of the connectors and having a driving groove in the front end portion thereof and a driven pin disposed in the other connector and engageable with the driving groove for connecting and disconnecting the connectors by rotating the fitting operation lever. According to the invention, between the disconnecting side wall of the driving groove and the driven pin there is provided a gap which allows the fitting operation lever to be rotated in a reverse direction when the connectors are not completely fitted with each other. That is, there is a certain amount of "play" in the lever so that the lever naturally rotates a predetermined angle in the un-locking direction.

When a pair of connectors are incompletely fitting with each other, that is, when the fitting operation lever is not locked, the operation lever can be moved reversely due to the gap provided between the disconnecting side wall of a driving groove in the operation lever and a driven pin and thus the operation lever is substantially displaced from its locking position. This makes it possible for an operator to visually determine whether the operation lever is correctly locked or not, so that there is eliminated the possibility that the connectors may be left in an unlocked state.

DETAILED DESCRIPTION OF THE PREFERRED EMBODIMENTS

Figure 1:
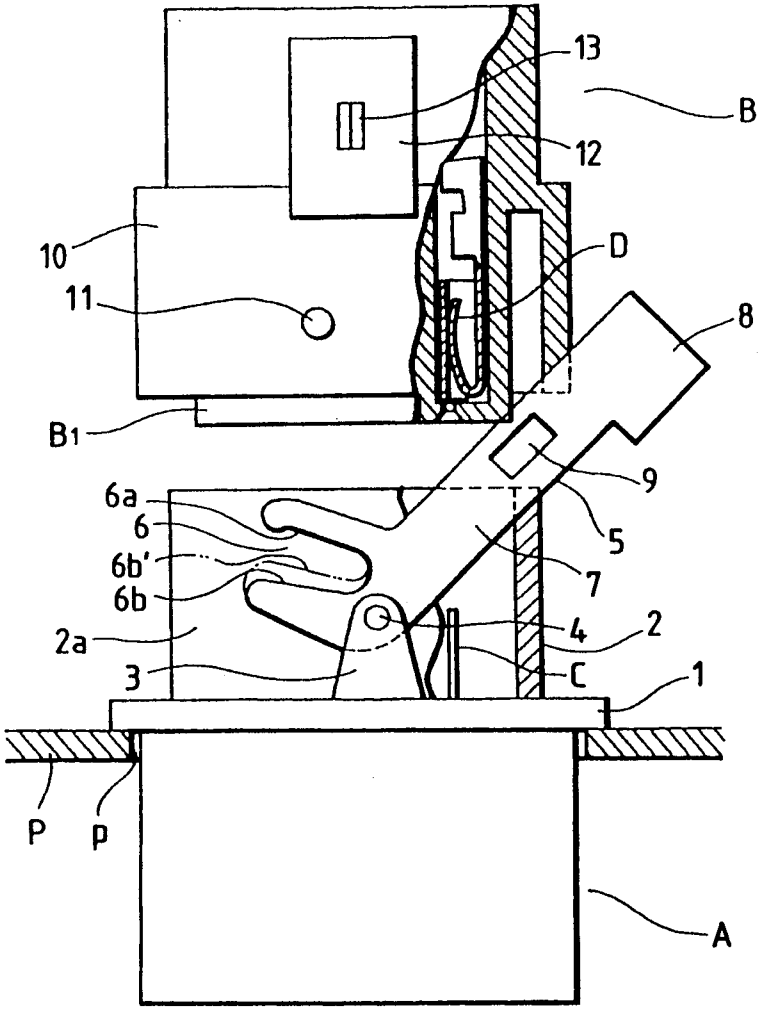
FIG. 1 is a partial sectional side view of main portions of male and female connectors, showing a state in which they are separated from each other.

Referring now to FIG. 1, reference character A designates a female connector and B designates a male connector which respectively include terminal metal fittings C and D therein. The female connector A is fitted in a mounting opening c formed in a panel P and is fixed to the panel P by conventional means such as screws or the like.

The female connector A includes in the upper half section thereof a body portion 2 which receives the male connector B through a flange portion 1 having an ear piece 3 erected thereon. The fitting operation lever 5 is rotatably disposed on the ear piece 3 by means of a pin shaft 4 so that it can be raised and lowered along the parallel outer wall surfaces 2*a* of the body portion 2.

The fitting operation lever 5 includes at one end thereof a driving groove 6 which opens upwardly when the lever 5 is in the lowered position, and an operation portion 7. The operation portion 7 includes in the leading end portion thereof extensions 8 and in the middle portion thereof a locking hole 9. Preferably, a fitting operation lever 5 may be disposed on both sides of the body portion 2 and the extensions 8 may be interconnected using a connecting piece (not shown) so that they can be pivotally mounted.

The male connector B includes a dust-proof hood 10 on the outer periphery of a connector main body portion $B_1$ to be fitted with the body portion 2. On the outer surfaces of the hood 10 is provided a driven pin 11 which is engageable with the driving groove 6 and a locking claw 13 is provided in an outwardly protruding wall portion 12 formed between the hood 11 and connector main body portion $B_1$.

Figure 2:
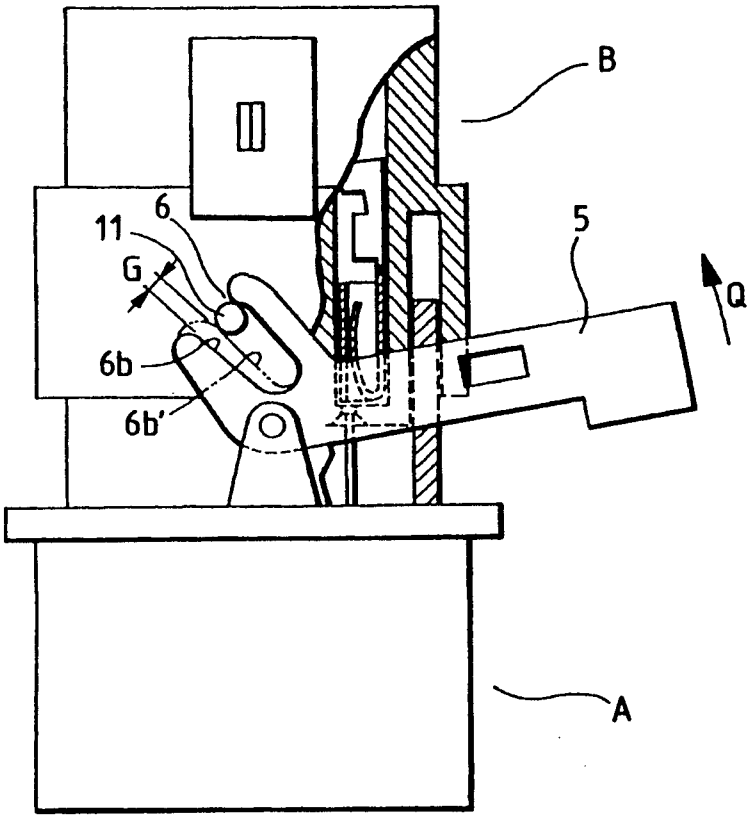
FIG. 2 is a side view of the above connectors, showing a state just before they are fitted with each other.

One of the two side walls of the driving groove 6 to be engaged with the driven pin 11 acts as a fitting side groove wall 6*a* and the other acts as a disconnecting side groove wall 6*b*. Normally, a groove width between the two groove walls 6*a* and 6*b* is set to be substantially equal to the outside diameter of the driven pin 11 so that the driving groove 6 can be mated with the driven pin 11. However, according to the invention, as shown in FIG. 2, the groove and pin are dimensioned in such a manner that a gap G exists between the driven pin 11 and disconnecting side groove wall 6*b*. In FIGS. 1 and 2, reference character 6*b*' designates a curved line of the disconnecting side groove wall of the conventional design, discussed above. The actual gap G, which will be described later, may be preferably set so that the operation lever 5 can pivot in the range of 10°–45° in the reverse (unlocking) direction from the locked position (or attitude). This corresponds to the amount of "play" in the lever.

Figure 3:
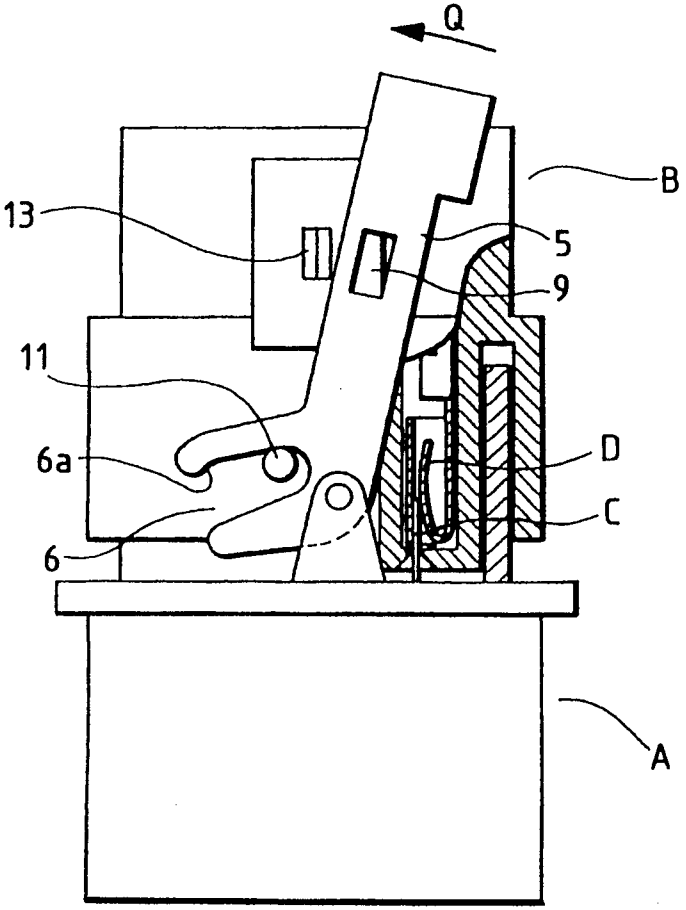
FIG. 3 is a side view of the above connectors, showing a state just before they are completely fitted and locked.

When the female and male connectors A and B are fitted with each other, the driven pin 11 of the male connector B enters the opening of the driving groove 6 of the operation lever 5 (FIG. 2). In this state, when the fitting operation lever 5 is rotated in the direction of arrow Q, the fitting side groove wall 6*a* of the driving groove 6 engages the driven pin 11 to thereby draw the male connector B toward the female connector, so that the interconnection of the female and male connectors A and B can be achieved with a small force due to the leverage achieved by the operation lever 5 (FIG. 3). Then, in the state shown in FIG. 3 in which one of the side edges of the fitting operation lever 5 is in contact with the locking claw 13, when the lever 5 is further rotated in the direction of arrow Q, the fitting of the female and male connectors A and B is completed and the terminal metal fittings C and D thereof are completely connected with each other. Simultaneously therewith, the locking claw 13 engages the locking hole 9 so that the lever 5 is locked, thereby locking the female and male connectors (FIG. 4).

Figure 5:
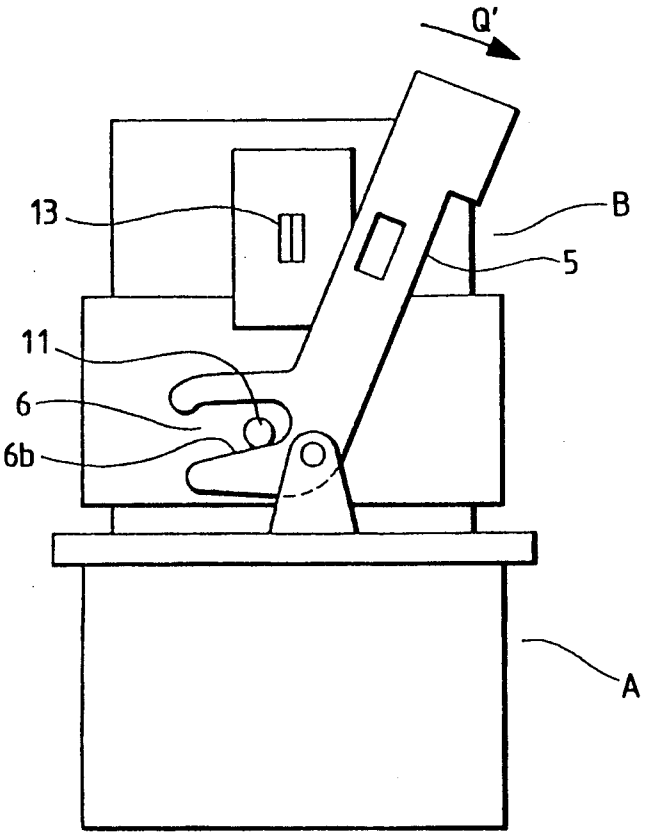
FIG. 5 is a side view of the above connectors, showing a state in which the fitting operation in FIG. 3 is interrupted.
Figure 7:
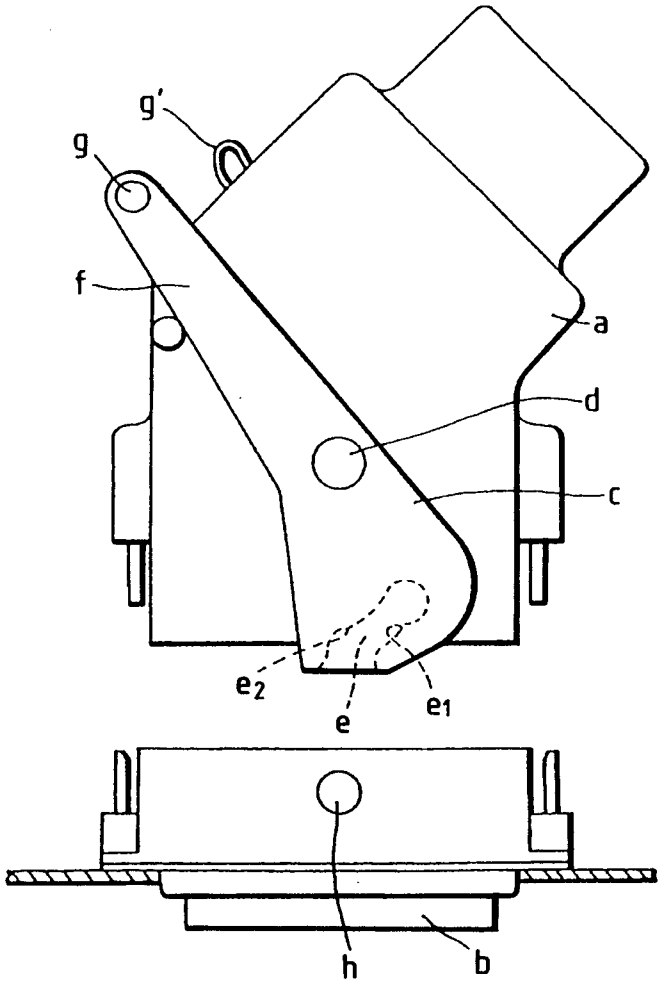
FIG. 7 PRIOR ART
FIG. 7 is a side view of conventional male and female connectors, showing a state in which they are separated from each other.
Figure 8:
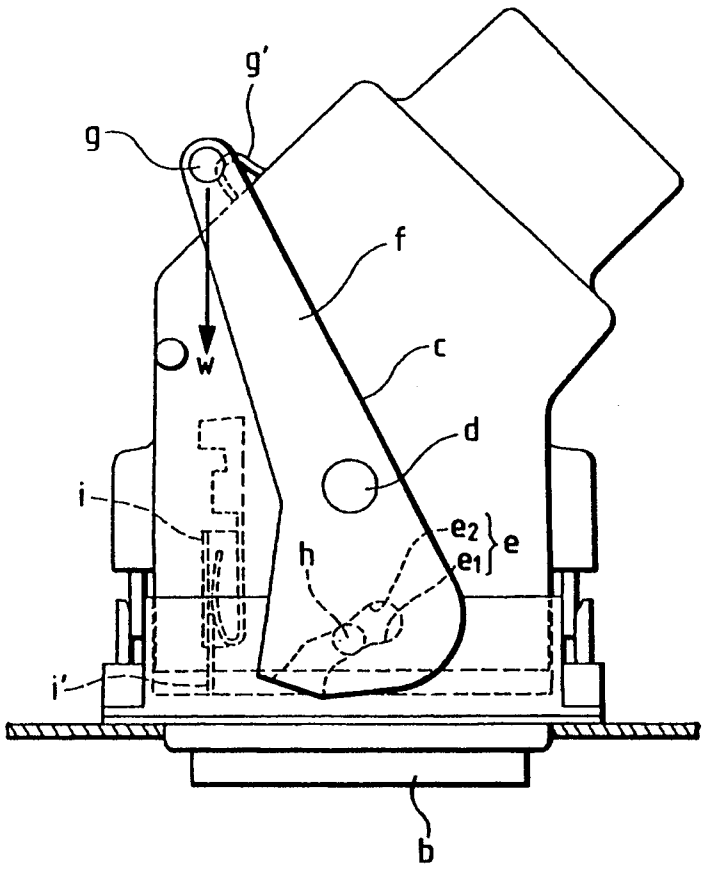
FIG. 8 PRIOR ART
FIG. 8 is a side view of the conventional connectors of FIG. 7, showing a state just before they are completely fitted and locked; and, FIG. 9 is a side view of the conventional connectors of FIG. 7, showing a state in which they are completely fitted and locked.
Figure 9:
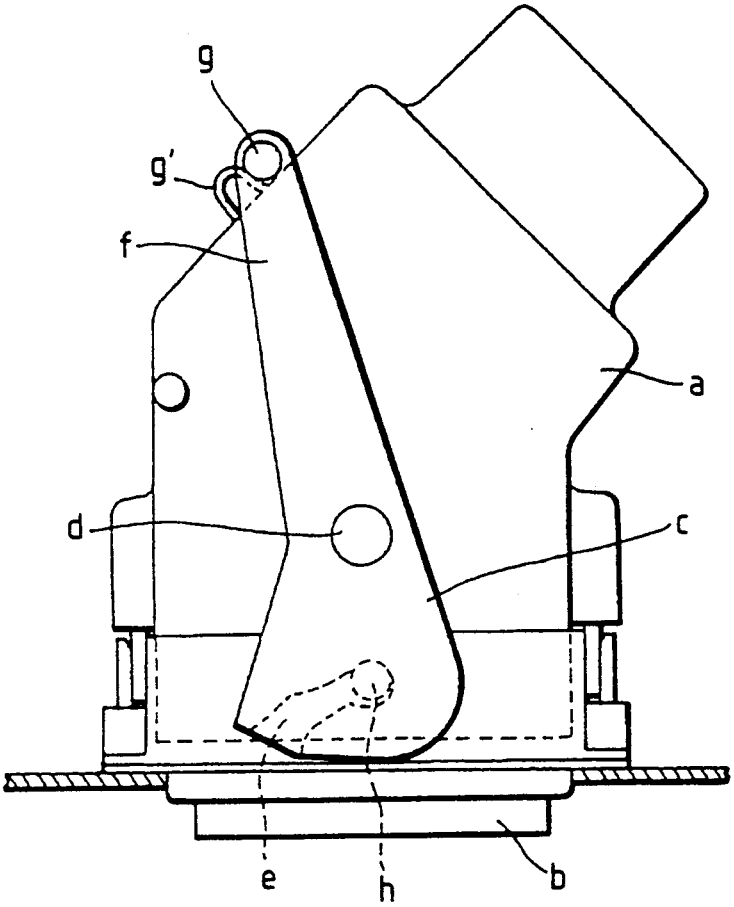
FIG. 9 PRIOR ART

However, if the rotational operation of the fitting operation lever 5 is stopped before the complete fitting and locking of the female and male connectors A and B are achieved, for example, in the state shown in FIG. 3, then gravity acts on the lever 5 urging it downwardly. As described above, the above-mentioned gap G exists between the disconnecting side groove wall 6*b* of the driving groove 6 and the driven pin 11 provided on the lever 5. Accordingly, as shown in FIG. 5, the lever 5 is rotated in the reverse direction (that is, in the direction of arrow Q') by its own weight and is finally positioned in an inclined manner when the disconnecting side groove wall 6*b* abuts against the pin 11. As a result, the fitting operation lever 5 is substantially displaced from its locked position as shown in FIG. 5, making it possible to visually determine at a glance the incomplete fitting and locking state of the female and male connectors A and B. Therefore, an operator is able to easily recognize the incomplete fitting condition and then properly fit the female and male connectors with each other completely. On the other hand, for inspection purposes, it is also quite easy to confirm whether the fitting is complete or not, which can eliminate the possibility of incomplete connections.

Figure 4:
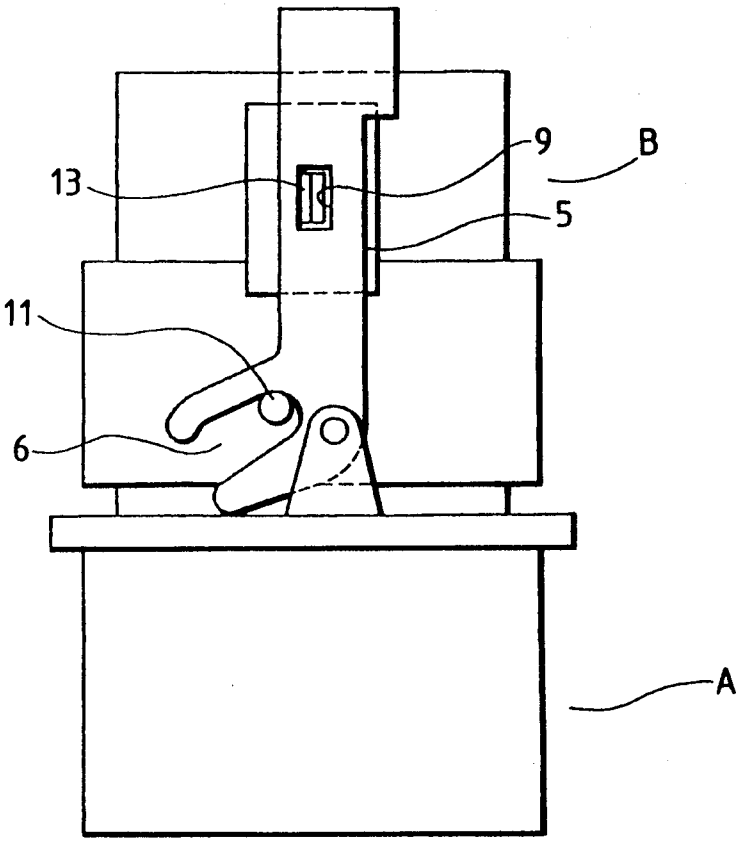
FIG. 4 is a side view of the above connectors, showing a state in which they are completely fitted and locked.

To disconnect the female and male connectors A and B from each other, the fitting operation lever 5 is simply rotated in the opposite direction to the direction shown in FIGS. 2–4. In this manner, the above-mentioned locking is removed so that the disconnecting side groove wall 6*b* of the driving groove 6 pushes out the driven pin 11.

It is noted that to insure that the fitting operation lever 5 rotates in the opposite (unlocking) direction when the female and male connectors A and B are incompletely fitted with each other, the extensions 8 may be formed through a swelling extrusion process to have an increased weight so that a greater moment acts on the operation lever 5. In addition to the above-described method in which the operation lever is rotated reversely due to its own weight, as an alternative there may be provided a spring interposed between the fitting operation lever 5 and female connector A which urges the lever 5 to rotate in the reverse direction.

Figure 6:
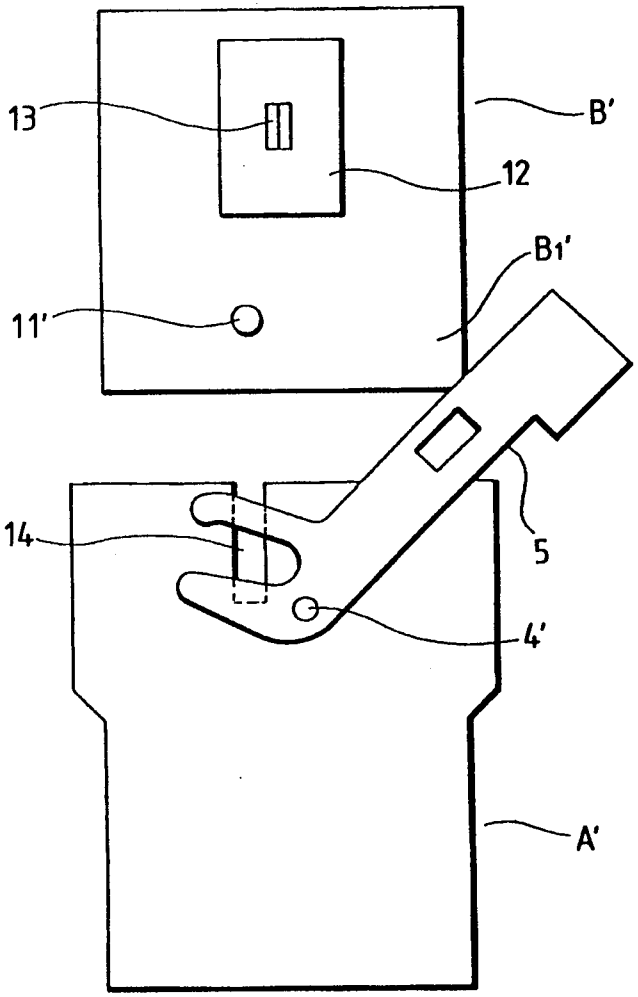
FIG. 6 is a side view of male and female connectors according to another embodiment of the invention, showing a state in which they are separated from each other.

Referring now to FIG. 6, there is shown a second embodiment of the connector device according to the invention. According to the second embodiment, the above-mentioned dust-proof hood 10 is omitted from a male connector B', while a driven pin 11' is provided directly in the connector main body portion $B_1$. On the other hand, the above-mentioned flange portion 1 and ear piece 3 are omitted from a female connector A', while a support shaft 4' is provided in the body portion 2 to support the fitting operation lever 5 in a rotatable manner. Further, a guide groove 14, corresponding to the driven pin 11', is formed so as to extend along the fitting direction. Other components of the second embodiment are the same as those shown in FIG. 1.

As has been described above, according to the invention, if the rotational operation of the fitting operation lever is stopped before the female and male connectors are completely fitted with each other, then the incomplete fitting state thereof can be detected at a glance. Therefore, the possibility of incompletely fitted connectors is eliminated.

What is claimed is:

1. A connector device, comprising:

a male connector and a female connector adapted to be connected with each other;

a fitting operation lever rotatably coupled to one of said connectors, said lever having a driving groove in a front end portion thereof;

a driven pin disposed in another one of said connectors and engageable with said driving groove of said lever for interconnecting said connectors to each other when said lever is rotated in a locking direction and for disconnecting said connectors when said lever is rotated in an opposite, un-locking direction; and reverse rotating means for allowing said lever to rotate a predetermined angle in said unlocking direction when said drive pin is at least partially engaged with said driving groove and said connectors are not completely connected to each other, wherein said predetermined angle is at least 10°.

2. The connector device of claim 1, wherein said predetermined angle is between 10° and 45°.

3. The connector device of claim 1, further comprising means for locking said lever in a locked position when said male and female connectors are completely engaged with each other.

4. The connector device of claim 1, wherein said driving groove includes a first side wall for urging said pin in an interconnecting direction and a second side wall for urging said pin in a disconnecting direction.

5. The connector device of claim 4, wherein said reverse rotating means comprises a gap disposed between said second side wall and said pin when said pin abuts against said first side wall.

6. The connector device of claim 5, further comprising urging means for urging said lever to rotate in said un-locking direction.

7. The connector device of claim 6, wherein said urging means comprises a weighted back end portion, opposite said front end portion.

8. A connector device, comprising:

a male connector and a female connector adapted to be connected with each other;

a fitting operation lever rotatably coupled to one of said connectors, said lever having a driving groove in a front end portion thereof;

a driven pin disposed in another one of said connectors and engageable with said driving groove of said lever for interconnecting said connectors to each other when said lever is rotated in a locking direction and for disconnecting said connectors when said lever is rotated in an opposite, un-locking direction, wherein a thickness of said groove is substantially greater that a thickness of said pin to allow said lever to rotate a predetermined angle in said un-locking direction when said drive pin is at least partially engaged with said driving groove and said connectors are not completely connected to each other and wherein said predetermined angle is at least 10°.

9. The connector device of claim 8, wherein said predetermined angle is between 10° and 45°.

* * * * *